United States Patent [19]

Smith et al.

[11] 4,111,781

[45] Sep. 5, 1978

[54] DANGLER ASSEMBLY FOR ELECTRO-CHEMICAL APPARATUS

[76] Inventors: Noel Edward Smith; Christopher Joseph Smith, both of 1099 Tillinghast Rd., East Greenwich, R.I. 02818

[21] Appl. No.: 851,117

[22] Filed: Nov. 14, 1977

[51] Int. Cl.[2] ..... C25D 17/20; C25D 17/10; C25D 17/12

[52] U.S. Cl. ..... 204/280; 204/213; 204/279; 204/286

[58] Field of Search ..... 204/212, 213, 280, 289, 204/297 R, 279

[56] References Cited

U.S. PATENT DOCUMENTS

| | | | |
|---|---|---|---|
| 2,249,609 | 7/1941 | Jackson | 204/213 |
| 3,366,566 | 1/1968 | Sandrock | 204/280 |
| 3,803,007 | 4/1974 | Jessup | 204/213 X |
| 3,844,923 | 10/1974 | Sandrock | 204/213 X |
| 3,846,271 | 11/1974 | Singleton | 204/213 |

*Primary Examiner*—Arthur C. Prescott
*Attorney, Agent, or Firm*—William Frederick Werner

[57] ABSTRACT

A cathode for an electro-chemical apparatus, such as an electroplating barrel, is provided with a contactor removably attached to the end of the electrical conductor cable in order to be discarded and readily replaced by another contactor after the plating material "builds-up" on the contactor to a condition where the plating inhibits electrical conductivity. The combination of a cathode and a length of insulated electrical conductor cable extending into the electroplating barrel is referred to in the art as a dangler. The subject dangler assembly comprises an insulated conductor cable having one end stripped of insulation.

3 Claims, 8 Drawing Figures

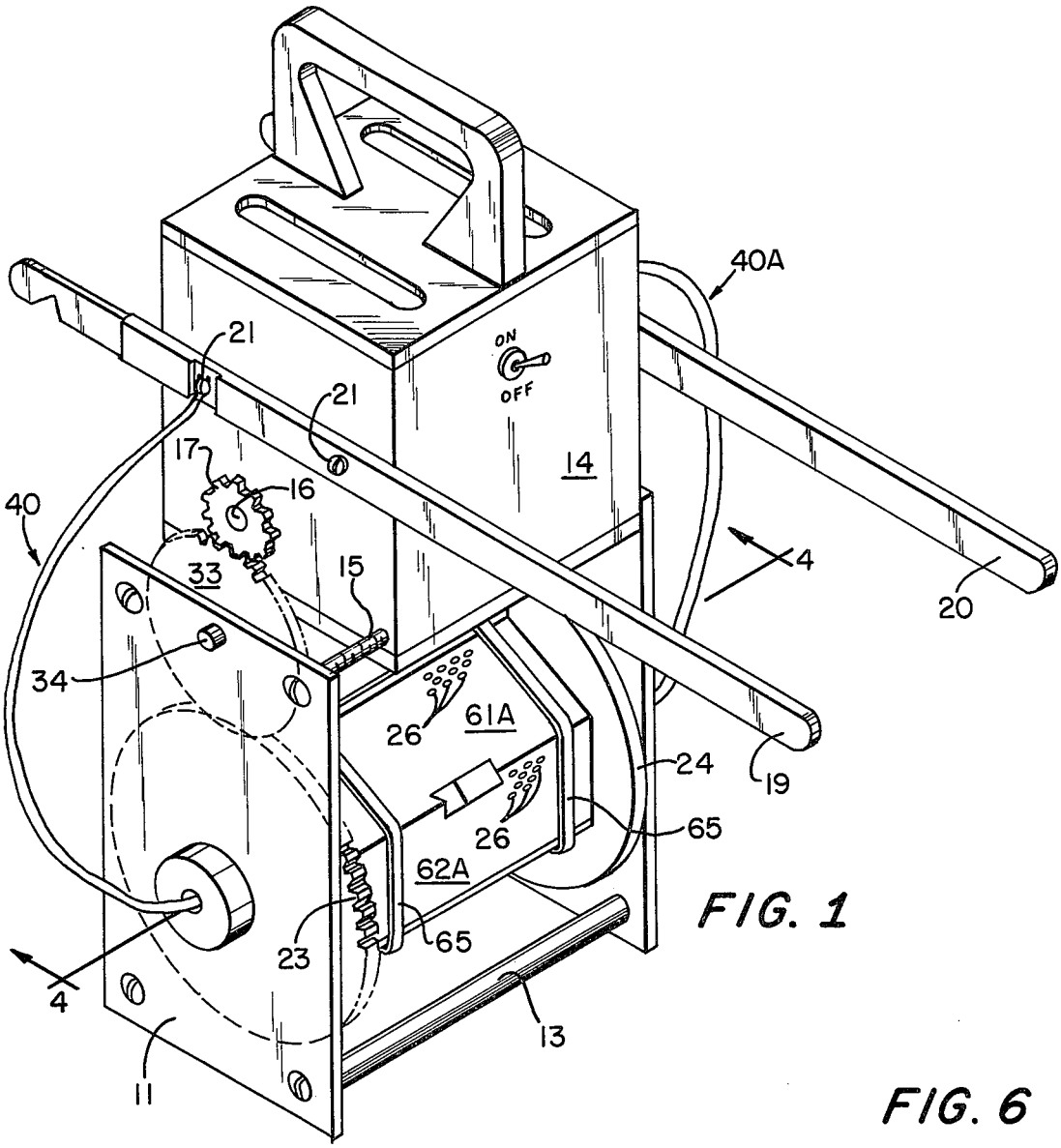
FIG. 1
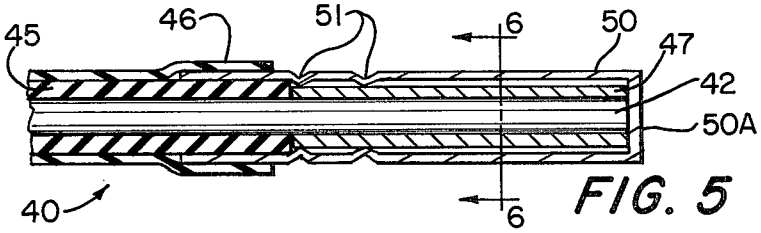
FIG. 5
FIG. 6
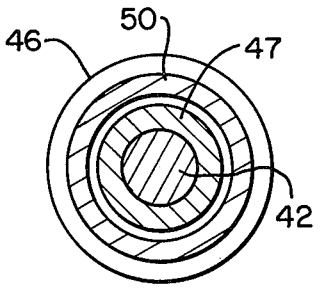
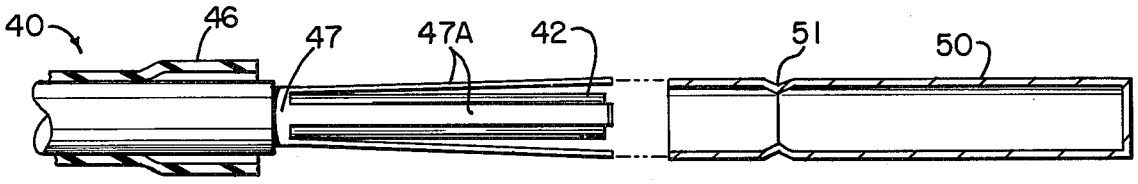
FIG. 7

DANGLER ASSEMBLY FOR ELECTRO-CHEMICAL APPARATUS

STATEMENT OF INVENTION

This invention relates to a dangler assembly for electro-chemical apparatus and more particularly to a removable, throwaway contactor.

PRIOR ART

The present dangler assembly represents an improvement upon dangler assemblies such as disclosed in U.S. Pat. No. 3,844,923 and U.S. Pat. No. 2,249,609.

Presently known dangler assemblies experience short life due to the hostile environment in which they are required to function, wherein corrosive chemicals used in plating operations permeate the connections between the conductor and the cathode. Additionally, the plating solution "builds-up" around the contactor to a condition where the plating inhibits electrical conductivity to the detriment of the plating operation.

In the past, all effort was directed to insure that the contractor was in absolute secure position attached to the cathode for positive electrical conductivity, even after long periods of use in a hostile environment.

The plating "build-up" on the contactor, while a nuisance, was not considered an important factor because the entire electrical conductor cable was discarded. With improvements in electrical conductor cables as manifest in the above cited prior art references, plating "build-up" causes the discard of expensive electrical conductor cables before normaly life usage was achieved.

OBJECTS OF THE INVENTION

Accordingly, it is a principal object of the present invention to provide a removable throwaway contactor for a cathode at the end of an electrical conductor cable.

Another object of the present invention is to eliminate the need mechanically of hammering or chemically removing the plating "build-up" on the contactor of a cathode electrical conductor cable.

Still another object of the present invention is to eliminate the need to disconnect the cathode electrical conductor cable from the electro-plating machine to remove the plating "build-up" on the contactor.

Other objects of the present invention will become apparent in part and be pointed out in part in the following specification and claims.

BRIEF DESCRIPTION OF DRAWINGS

Referring to the drawings in which similar reference characters refer to the same parts:

FIG. 1 is a perspective view of an electro-chemical plating machine showing the mounting of an insulated electrical conductor cable cathode having a contactor;

FIG. 5 is a fragmentary medial cross sectional view taken through the cathode end of an insulated electrical conductor cable cathode provided with a contactor;

FIG. 6 is a vertical cross sectional view, taken on line 6—6 of FIG. 5;

FIG. 7 is a view similar to FIG. 5, showing a modified form of a cathode-contactor assembly;

Figure 8:
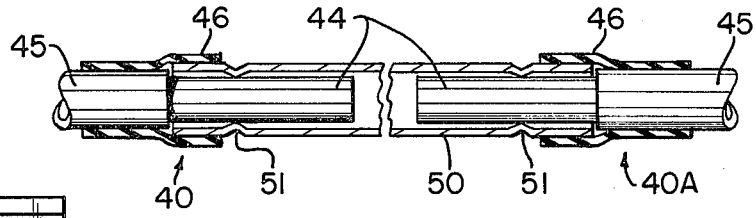
FIG. 8 is another view, similar to FIG. 5, showing still another modified form of cathode-contactor assembly.
Figure 2:
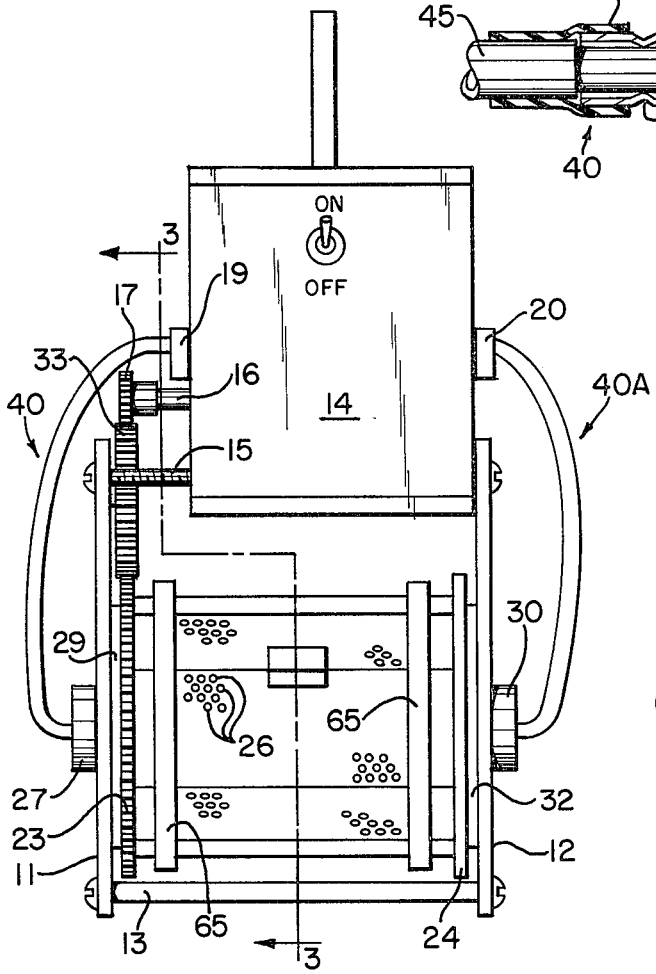
FIG. 2 is a front elevational view of FIG. 1.
Figure 3:
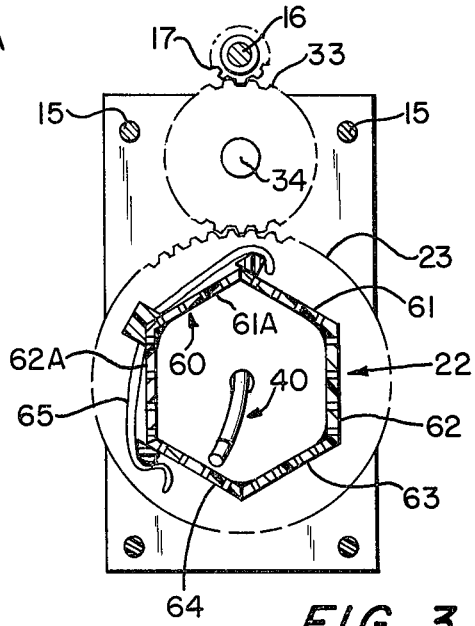
FIG. 3 is a vertical sectional view taken on line 3—3 of FIG. 2.
Figure 4:
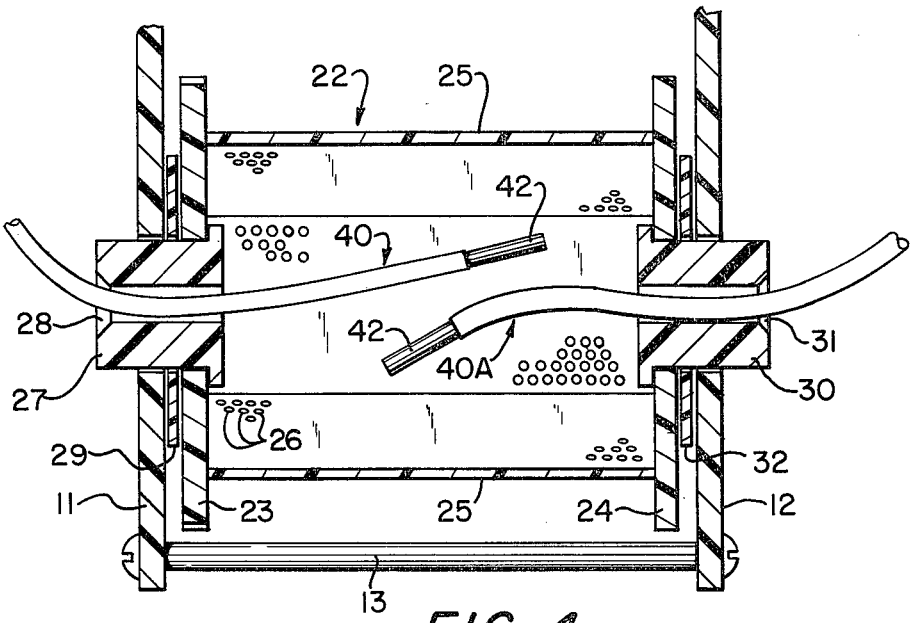
FIG. 4 is a fragmented horizontal cross sectional view taken on line 4—4 of FIG. 1.

The electro-chemical plating machine is generally designated by reference numeral 10. It consists of a left side wall 11 and a right side wall 12, held in spaced relation by rods 13. A motor housing 14 is supported in left side wall 11 and right side wall 12 by means of threaded rods 15. A motor (not shown) is housed in motor housing 14 with a motor shaft 16, projecting through housing 14, and provided with a pinion 17. An on-off switch is fastened to housing 14. A left side cathode bar 19 and an opposite and parallel right side cathode bar 20 are fastened to motor housing 14 by means of screws 21.

A hexagon-shape or six-sided cylinder, generally indicated by reference numeral 22, consists of a left-side gear disk 23 and a right side disk 24 held in spaced relation by four of said six sides 61, 62, 63, 64, fastened on opposite ends to said disks 23, 24. The other two sides 61A, 62A, fastened together as a unit 60 mate with the four fixed sides 61, 62, 63, 64, to form the six-sided cylinder 22. Straps 65 removably secure said unit 60 to said four sides 61, 62, 63, 64. All six sides are provided with perforations 26. A left side bushing 27 provided with an axial passageway 28 is fastened to left side disk 23 and is rotatably mounted in left side wall 11. A spacing member 29 is supported upon bushing 27 and is interposed between left side disk 23 and left side wall 11. Similarly, a right side bushing 30 provided with an axial passageway 31 is fastened to right side disk 24 and is rotatably mounted in right side wall 12. A spacing member 32 is supported upon bushing 30 and is interposed between right side disk 24 and right side wall 12.

An intermediate gear 33 is rotatably attached to a stub shaft 34 fastened in left side wall 11. Pinion 17, intermediate gear 33 and left side gear disk 23 are interconnected to form a train gear drive from motor shaft 16 to cyliner 22.

A flexible insulated electrical conductor cable cathode, generally designated by reference character 40, is fastened to cathode bar 19 by means of screw 21 for electrical connection and is passed through passageway 28 into chamber 41 of cylinder 22 with the end of the cathode 42 electrically exposed. Similarly, a second flexible insulated electrical conductor cable cathode 40A is fastened to cathode bar 20 and is passed through passageway 31 into chamber 41 of cyliner 22 with the end of the cathode 42 electrically exposed. Sides 61A, 62A provide an entrance into chamber 41.

Reference is now made to FIGS. 5 and 6, wherein the working end of insulated electrical conductor cable cathode 40 is shown in medial cross section. Cable 40 consists of a cathode solid wire core 42 or strands of wire twisted together to form a core of electrical conductive material. Electrical insulation 45 covers wire core 42 most of its length, except at either end where electrical exposure contact is provided for core 42. An insulation covering 46 embraces isulation 45 to protect the insulation against damage. A tube 47 of electrical conductive material is pressed upon core 42 to fasten said tube 47 to said core 42 to insure good electrical conductivity and to strengthen the head of the dangler. Tube 47 preferably abuts the end of insulation 45. A shield or contactor 50 fabricated from electrically conductive material in the form of an open ended casing (with one end closed by a wall 50A) is provided with one or more (shown as two) crimping rings 51 which, when contactor 50 is slid over tube 47 embraces tube 47 to provide electrical contact with tube 47 and a friction grip with tube 47. Contactor 50 is of sufficient length to extend from wall 50A engaging the end of tube 47 to a position between insulation 45 and insulation covering 46, for purposes which will presently appear.

In operation, electro-chemical plating machine 10 is suspended over a barrel containing a liquid plating solution, by way of example, of chrome or nickel. Left side cathode bar 19 and right side cathode bar 20 rest upon the top edge of the barrel with cylinder 22 partially or wholly emerged in the liquid plating solution. Pieces to be plated, such as parts forming cuff links used as costume jewelry, are placed in chamber 41 to a point below the solution level where the solution contacts the work and contactors 50. The contactors 50 are the cathodes. The plating solution is the anode. Cylinder 22 is rotated by an electrical motor (not shown) which rotates motor shaft 16, gear train 17, 33, 23 and bushings 27, 30. The rotating cylinder 22 agitates and tumbles the pieces to be plated during the plating operation with the work pieces bouncing against contactors 50. Cathode cables 40, 40A are subjected to severe torsional and bending movements. As the plating is applied to the work pieces, it also is applied to the contactors 50 where is builds-up around the electrically conductive contactors 50. However, the plating does not deposit upon insulation covering 46, a non-electrical conductor. After a period of time, the plating deposit build-up, electrically insulates contactors 50 so that the plating deposit on the work pieces becomes less and less efficient to a point of no deposit. The plating deposit must be removed. According to the present invention, the contactors 50 being frictionally held to tubes 47 are readily removed from tubes 47, discarded and replaced with new contactors 50, thus providing a time saving, efficient, inexpensive dangler head replacement.

FIG. 7 shows a modified dangler head replacement in the form of a contactor 50 which is frictionally gripped by spring fingers 47A formed in the outer length of tube 47 fastened to the end of cathode 42. Crimp 51 grips tube 47 as previously described. Contactor 50 has the inboard end located between insulation 45 and insulation covering 46, as previously described.

FIG. 8 illustrates still another modified form of dangler head replacement. Instead of two contactors 50 one contactor 50 embraces oppositely disposed tubes 47. Replacement of tube 50 is as previously described. Tube 50 is removed from tube 47 on cable 40 and then is removed from tube 47 on cable 40A.

Having shown and described preferred embodiments of the present invention by way of example, it should be realized that structural changes could be made and other examples given without departing from either the spirit or scope of this invention.

What we claim is:

1. A dangler assembly for an electro-chemical apparatus comprising:

(a) a cathode core,
(b) insulation encasing said cathode core,
(c) insulation covering encasing said insulation,
(d) said cathode core extending beyond said insulation to provide an exposed end,
(e) a tube of electrical conductive material,
(f) means fastening said tube to said cathode core,
(g) a contactor comprising a casing having one open end, and a wall closing one end,
(h) said contactor located over said tube with said open end located between said insulation and said insulation covering,
(i) and means removably fastening said contactor with said tube in electrically conductive relationship.

2. A dangler assembly for an electro-chemical apparatus comprising:

(a) A cathode core consisting of strands of wire,
(b) insulation encasing said core,
(c) insulation covering encasing said insulation,
(d) said cathode core extending beyond said insulation to provide an exposed end,
(e) a tube of electrically conductive material provided with a plurality of spring fingers,
(f) means fastening said tube to said exposed end,
(g) a contactor fabricated from electrically conductive material, comprising a casing having an open end, and a wall closing the other end, and a crimping ring,
(h) said contactor located over said tube with the open end located between said insulation and said insulation covering, and with said crimping ring removably securing said contactor to said tube, and with said spring fingers contacting the inside of said casing.

3. A dangler assembly for an electro-chemical apparatus comprising:

(a) two cathode cores, each core consisting of a plurality of strands of wire,
(b) insulation encasing each cathode core,
(c) insulation covering encasing said insulation,
(d) each core extending beyond said insulation to provide an exposed end on each core,
(e) a tube of electrically conductive material for each core,
(f) means fastening *a*, respective, tube to *a*, respective, core,
(g) a contactor comprising a casing having two open ends adapted to receive and house said two cathode cores, one on each end,
(h) and means to removably secure said contactor to said two cathode cores.

* * * * *